US007441364B2

(12) United States Patent
Rogers et al.

(10) Patent No.: US 7,441,364 B2
(45) Date of Patent: Oct. 28, 2008

(54) ADJUSTABLE RAIL LIGHT MOUNT

(75) Inventors: William H. Rogers, St. Augustine, FL (US); Matthew E. McKendrick, Jacksonville, FL (US)

(73) Assignee: Safari Land Ltd., Inc., Ontario, CA (US)

( * ) Notice: Subject to any disclaimer, the term of this patent is extended or adjusted under 35 U.S.C. 154(b) by 119 days.

(21) Appl. No.: 11/642,169

(22) Filed: Dec. 20, 2006

(65) Prior Publication Data

US 2008/0148619 A1 Jun. 26, 2008

(51) Int. Cl.
*F41G 1/00* (2006.01)
*F41G 1/35* (2006.01)

(52) U.S. Cl. ..... 42/146; 42/114

(58) Field of Classification Search ..... 42/114, 42/115, 117, 146
See application file for complete search history.

(56) References Cited

U.S. PATENT DOCUMENTS 1,865,127 A * 6/1932 McKeen ..... 24/329
1,950,835 A * 3/1934 Zajac ..... 362/114
2,336,718 A * 12/1943 Davis ..... 356/247
3,739,167 A * 6/1973 Avery ..... 362/157
4,894,941 A * 1/1990 Karow, Jr. ..... 42/146
5,042,186 A * 8/1991 Bechtel ..... 42/114
5,359,779 A * 11/1994 Polk et al. ..... 42/115
6,675,521 B1 * 1/2004 Kim ..... 42/114
2005/0204603 A1 * 9/2005 Larsson ..... 42/146
2007/0044365 A1 * 3/2007 Deken ..... 42/146
2007/0137087 A1 * 6/2007 Florea et al. ..... 42/90

* cited by examiner

*Primary Examiner*—Bret Hayes
(74) *Attorney, Agent, or Firm*—Arthur G. Yeager

(57) ABSTRACT

An adjustable and removable rail light mount for attachment to a firearm having a mounting rail includes a rail mount attached to a rail and a light carrier rotatably attached to the rail mount to position a light to the left or right of a firearm by way of an axle carried by the rail mount. The axle fits through the rail mount and the light carrier. Passageways in the rail mount and the light carrier for the axle include grooves that engage detent bosses on the axle to maintain the light carrier in the selected location. Light carrier is removable when it is rotated to a centered downward position.

20 Claims, 12 Drawing Sheets

40
26A
39
27

SEE FIG 20
16
38
26
41
26A
39

38
40
39
26A
41
38
26
41

38
26B
26B
36
38
16

38
36
26
16
43
26
27
23B 16
36
38

16
38
26A
39
38
41

ADJUSTABLE RAIL LIGHT MOUNT

CROSS-REFERENCE TO RELATED APPLICATION

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to mounting devices for lights attached to a firearm and particularly to adjustable positioning of rail-mounted lights on a firearm.

2. Related Art

Historically, it has been difficult for even skilled marksmen to coordinate a hand held flashlight with a firearm at night. The modern two handed handgun shooting technique requires the support hand to wrap around the hand which controls the firing of the weapon in order to substantially control the weapon during firing. The user must relinquish some control of the handgun if the support hand is used to hold or even switch on and off a light while firing. In recent years the industry has improved upon this skill by incorporating a mounting rail with locking indentions, into the frame of the firearm, inline with and just below the barrel of the firearm. A specially designed light module is attached to the firearm using the integral mounting rail on the firearm. The light module is secured to the firearm's mounting rail just forward of the front of the trigger guard on pistols and near the front of the hand guard or fore stock of shoulder firearms. A light pressure switch is mounted to the grip of the firearm in some designs and in other designs the switches are incorporated into the light module itself. In the later designs, the light modules have momentary and on/off toggle switches incorporated into the rear of such modules. These switches are operated usually with the support hand and must be ambidextrous in design. The toggle type switches require practice and training in order for someone to become proficient with the module while firing the firearm at night while maintaining control of the firearm. In the above referenced designs, the light module is relatively expensive and in some cases, costs near the cost of the firearm. In most designs, the installation and removal of the light unit is not user friendly and a majority of the users dedicate the light module to the firearm. A specially designed holster is then required to fit the firearm with light attached. Common sense and proper training would prevent the user from using the dedicated light in a no risk illumination scenario and therefore a secondary flashlight is required for such uses. The substantial disadvantages of the prior art device require a new approach.

BRIEF SUMMARY OF THE INVENTION

In one aspect of the present invention there is provided an adjustable rail light mount for removable attachment to a firearm having a mounting rail with a notch therein comprising: a rail mount removably attached to a rail of such firearm; a light carrier adapted for supporting a light attachable to the rail mount; an axle member affixed to the rail mount; said carrier having a passageway for receiving a portion of the axle therein for rotatably mounting the carrier to the rail mount; and a pair of cooperating engaging members located between the axle and the passageway in the carrier for securing the carrier in at least one position to locate a light carried by the carrier on at least one side of such firearm. The rail mount includes a pair of spaced subtending flanges each having a longitudinal passageway therethrough, the flanges defining an interior mounting notch therebetween, the passageways being aligned with a common longitudinal axis. The light carrier includes an upstanding post member having a body and a longitudinal passageway therethrough aligned with the common axis, the axle being mounted through the passageways in the flanges and the passageway in the post member. The cooperating engaging members includes spaced first engaging elements formed in the passageway in the post member, and spaced second engaging elements formed on the axle, the first and second engaging elements cooperating to lock the second mounting member in a first position to locate a carried light on the left side of such firearm and a second position to locate a carried light on the right side of such firearm. The engaging members include spaced third engaging elements in the passageways in the flanges cooperating with the second engaging elements to secure the axle therein. The light carrier includes stop means for engaging a portion of a rail on such firearm to inhibit forward movement of the mount when the light carrier is in the first or second position. The first engaging elements are formed as a plurality of longitudinal grooves, the second engaging elements are formed as a plurality of longitudinal bosses, each said boss located in one groove. The rail mount also includes a channel member for attaching the rail mount to a rail of such firearm. The light carrier includes a hollow body for supporting a light having a generally cylindrical shape. Also included is a belt clip including a hollow body sized to locate the light carrier in the body of the clip, an arm member extending from the body of the clip for removably attaching the belt clip to a belt of a user when the rail mount is removed from a firearm.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE PRESENT INVENTION

Objective

The present invention is directed toward an inexpensive device that can use a simple end cap, push button switch operated flashlight such as the Coast "Tac Torch". The Tac Torch or similarly designed light is first adjusted and locked into place. Then the device with light installed is easily and quickly slipped onto the integral mounting rails of the firearm. The unit is secured in place by rotating the light either to the right or left side of the frame of the firearm. A right hand shooter, using a modern two handed shooting technique, would position the light to the left of the frame and vice versa for a left handed shooter. The device, after adjustment, would align the end cap switch of the light such that it can be operated by the thumb of the support hand without affecting the necessary two handed grip. The shooter can engage the push button for momentary illumination or can depress it all the way for the on position. The device can easily and quickly be removed from the firearm so that in cases where it is used with a handgun, the handgun can be quickly reholstered in a standard holster. Because of the simple nature of the device, the operator could use the detached device as a standard flashlight, eliminating the need of having to carry a second light. A further design objective of this invention is the incorporation of a simple belt clip to the device itself so that it can be easily stored on the user's belt when it is detached from the firearm.

Introduction

The adjustable rail light mount is composed of two main components. One component secures the small cylindrical flashlight and the second component mates to the integral rail portion of the frame of a handgun or the fore grip of a shoulder firearm. The two components cooperate via an extended arm adjacent the light component and held to the frame mating component by a pivoting axle. The axle has one or more small lobes or detent bosses that match indentions in the receiver portion of the light component so that the light can be indexed in position. A locking tab is incorporated on either side of the extended arm of the light component in such a way that when the light component is pivoted in full position to the right or left, the locking tab is aligned with a locking slot provided by the firearm. This secures the device on the firearm so that it cannot come off during use. Through the use of a frictional lock, the light component is held in position to the right or the left in such a way to align the push button switch with the user's support thumb. The light can be adjusted fore and aft in the light component so that the user can activate the push switch by the support hand thumb without disturbing the modern two handed shooting technique. An added feature is a belt clip incorporated into the light component so that it can be easily stored on the user's belt when the mount and/or light is detached from the firearm.

Construction

Figure 1:
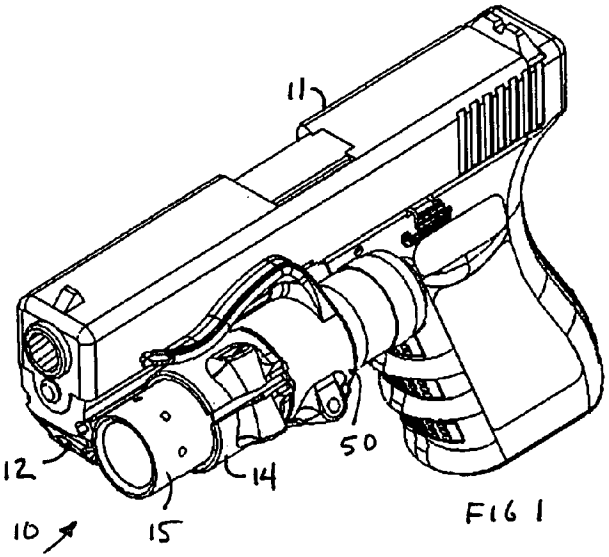
FIG. 1 is a perspective view of a firearm carrying the adjustable rail light mount in accord with the present invention in a left position for a right hand grip.
Figure 2:
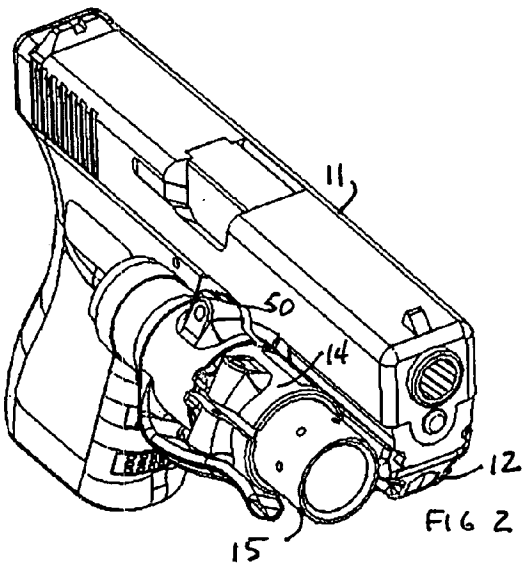
FIG. 2 illustrates the mount of FIG. 1 in a right position for a left hand grip.
Figure 3:
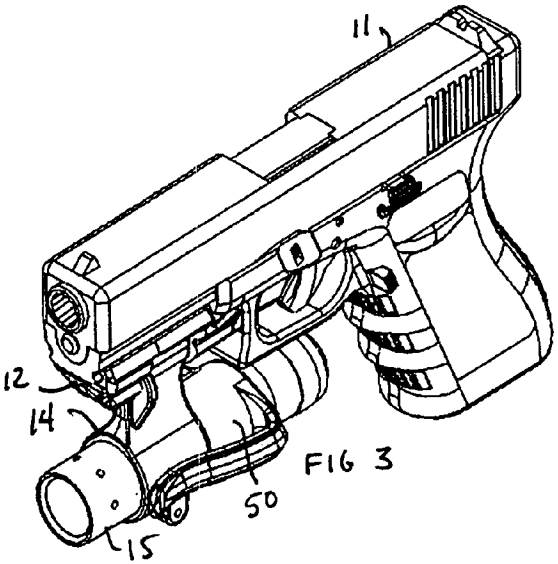
FIG. 3 illustrates the mount of FIG. 1 in a center position.

With respect now to the drawings, FIGS. 1-3 illustrate the adjustable rail light mount 10 in accord with the present invention and is shown rotated and locked to the left for a right hand grip (FIG. 1); rotated and locked to the right for a left hand grip (FIG. 2); and a releasable center position below the gun (FIG. 3).

Figure 4:
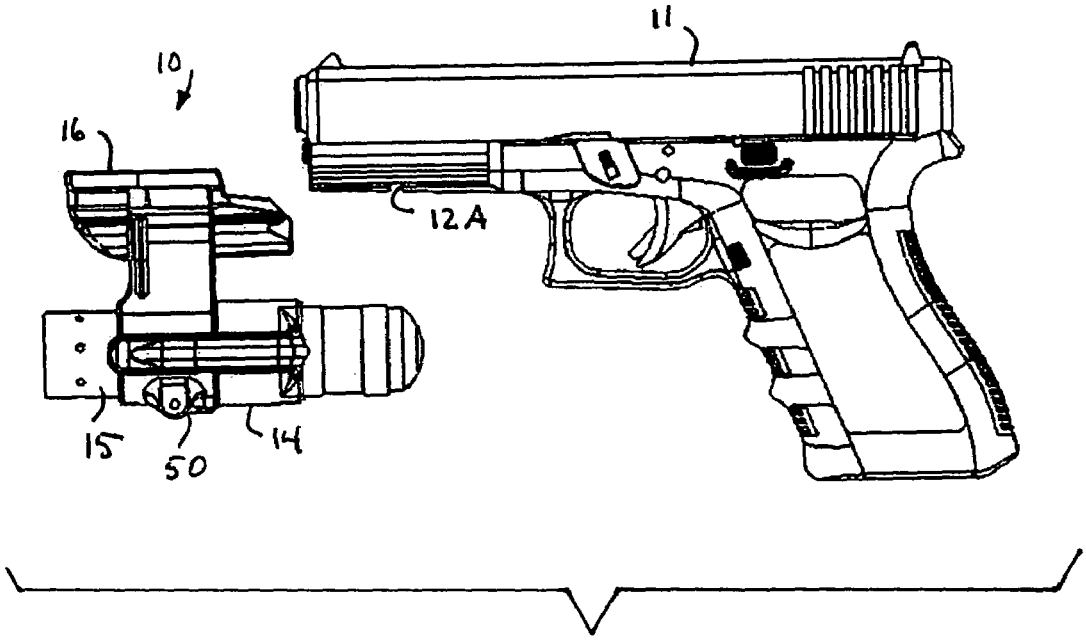
FIG. 4 illustrates the installation of the mount of FIG. 1.

FIG. 4 illustrates the light mount 10 being installed on a firearm 11 having a standard integral rail portion 12 as understood in the art.

Figure 5:
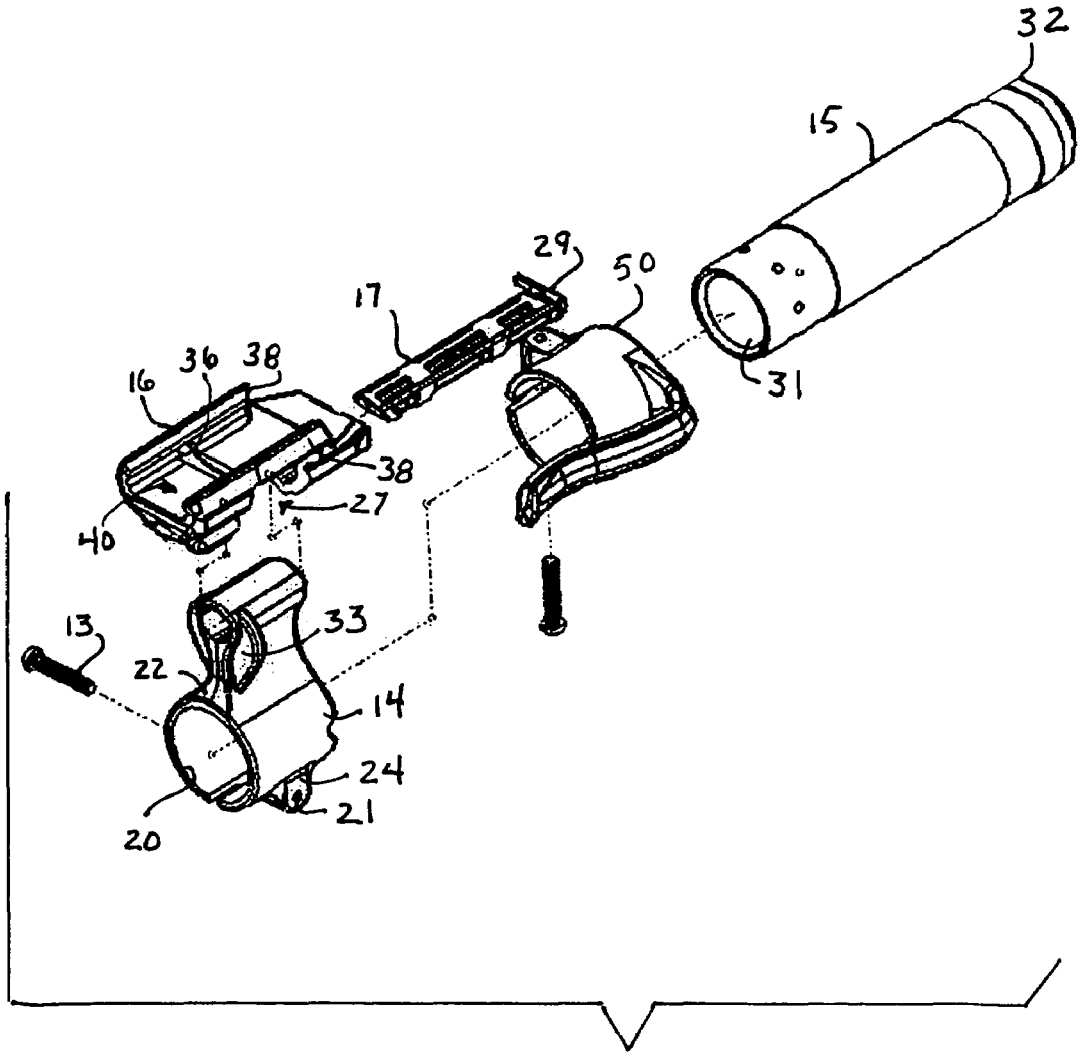
FIG. 5 is and exploded view of the mount of FIG. 1.
Figure 6:
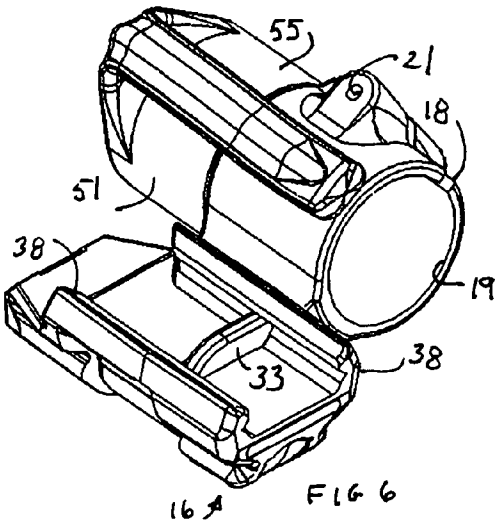
FIGS. 6-9 are various views of the mount of FIG. 1.
Figure 8:
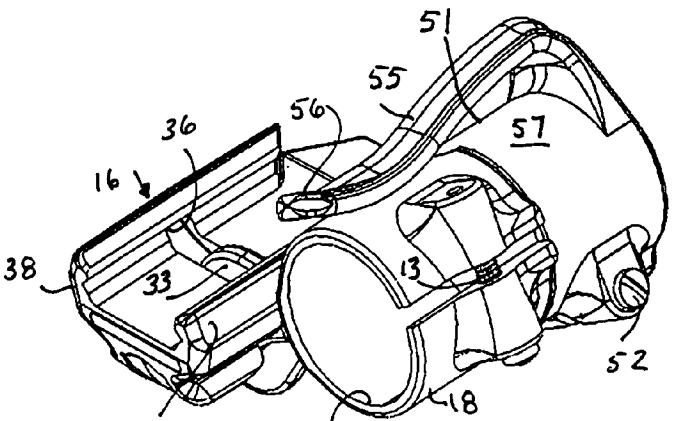
Figure 9:
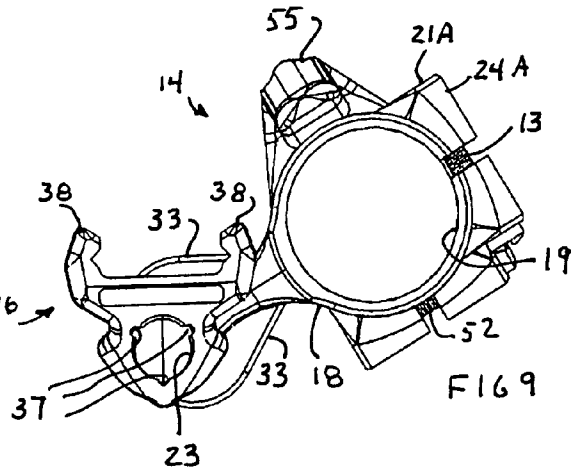
Figure 7:
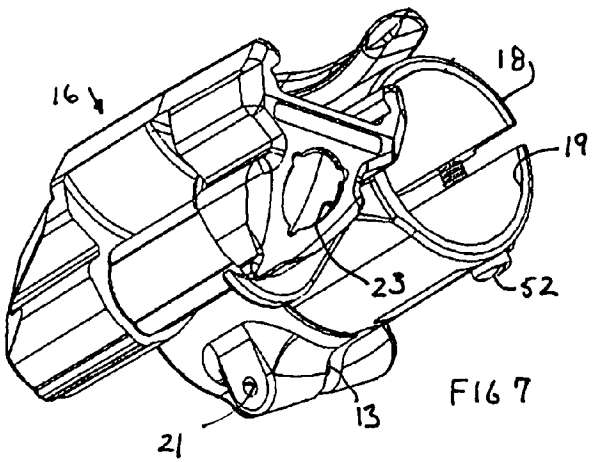
Figure 10:
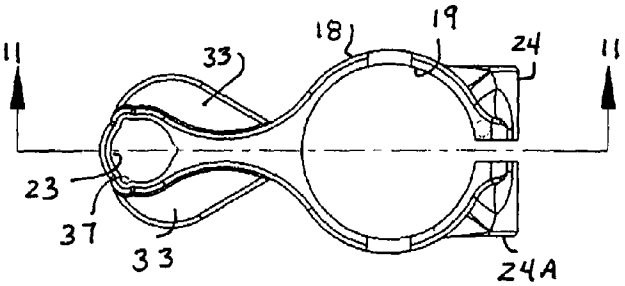
FIG. 10 is a rear view of the rotational component of FIG. 5.
Figure 12:
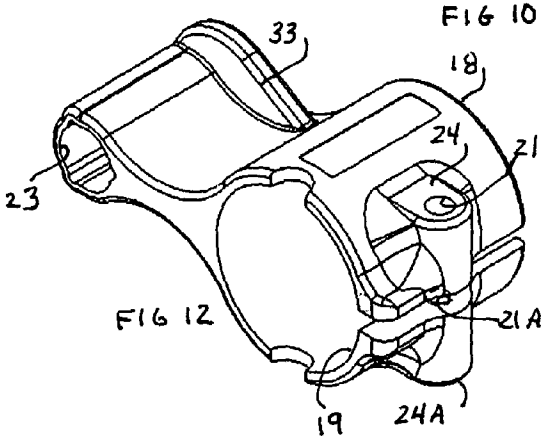
FIG. 12 is a perspective view of the rotational component of FIGS. 5 and 10-11.
Figure 11:
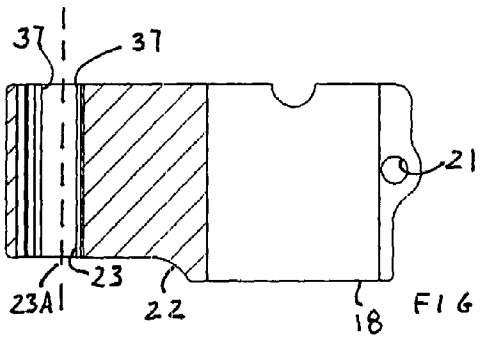
FIG. 11 is a cross-section of the rotational component of the mount of FIG. 10.
Figure 13:
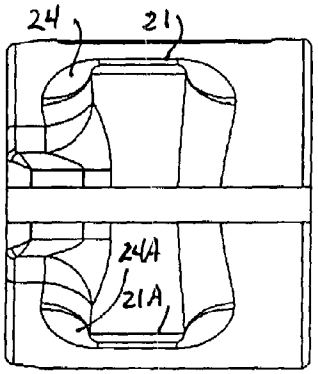
FIG. 13 is a side view of the rotational component of FIG. 12.

FIG. 5 illustrates the components of the rail light mount. A conventional flashlight frictionally carried in rotatable light mount 14 and is secured into place by tightening screw 13. The light mount rail body 16 engages a rail 12 having a rail slot 12A and cooperates with a locking axle 17 for selectively rotatably connecting a light mount 14 to rail body 16, as will be discussed more fully hereinafter.

Light carrier 14 (FIGS. 6-13) includes a cylindrical body 18 having a interior space 19 to slidably mount light 15. Inwardly directed flange 20 limits forward movement of light in body 18. Flanges 24 and 24A are spacedly opposed and respectively have a passage 21 and aligned threaded passage 21 A through which screw 13 extends and tightens light carrier 14 around light 15.

A laterally extending post portion 22 includes a passageway 23 with axis 23A therethrough for receiving locking axle 17 which is secured to body 16. Post portion 22 includes front and rear surface 34, 35 respectively.

Figures 14, 15, 16, 17, 18, 19, 20:
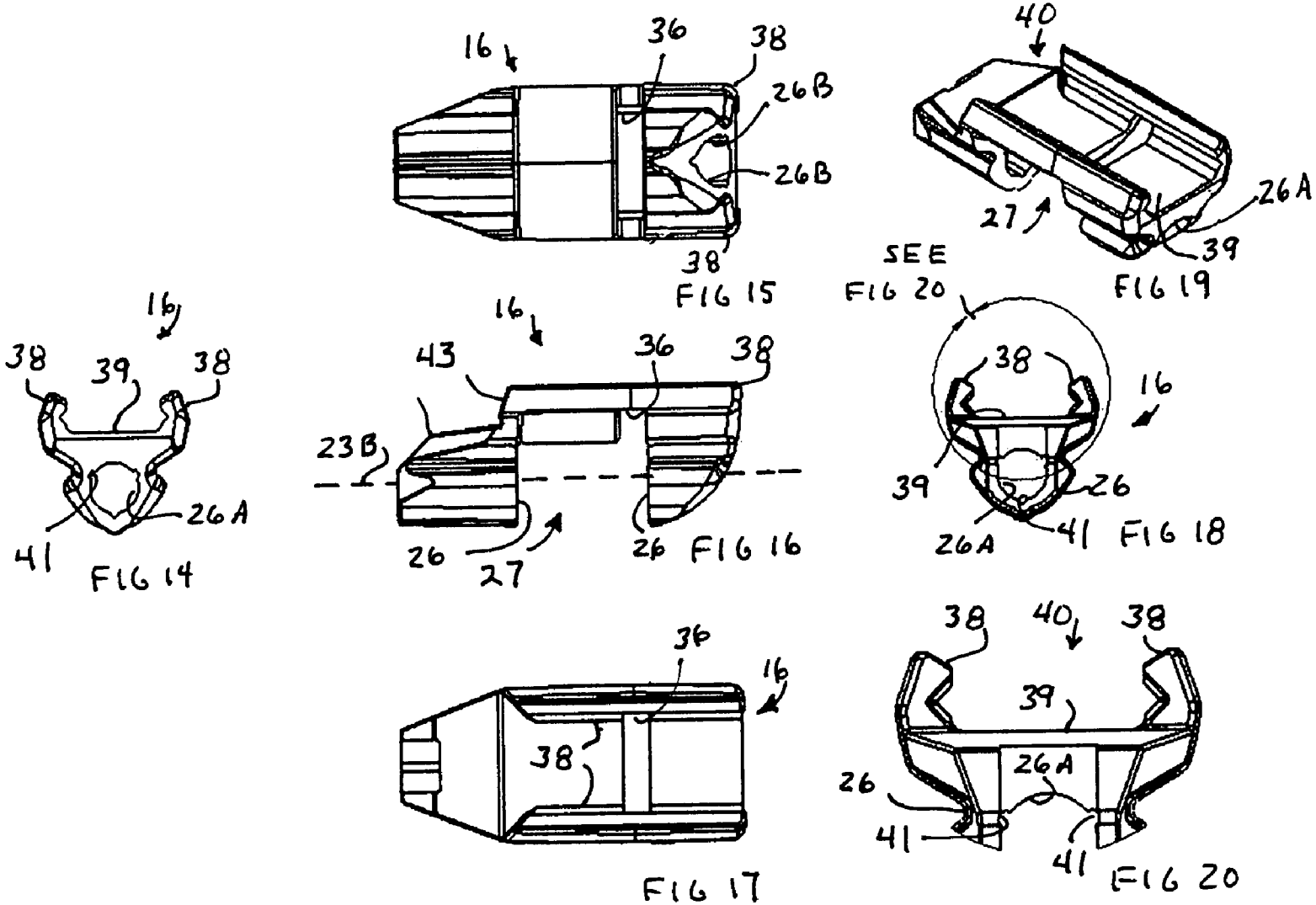
FIGS. 14-20 are various views of the body of the rail mount in accord with the present invention.
Figure 21:
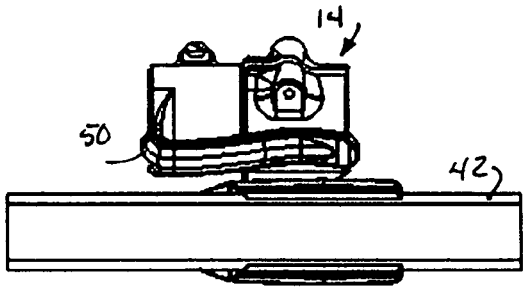
FIGS. 21-26 are various views of the rail mount of FIGS. 6-9 shown installed on a standard Picatinny rail.
Figure 25:
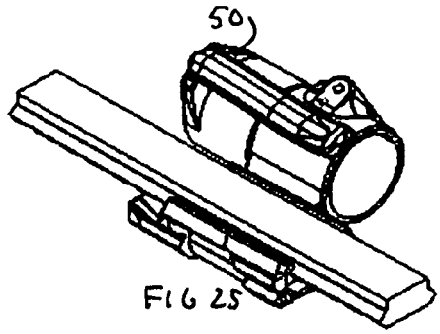
Figure 22:
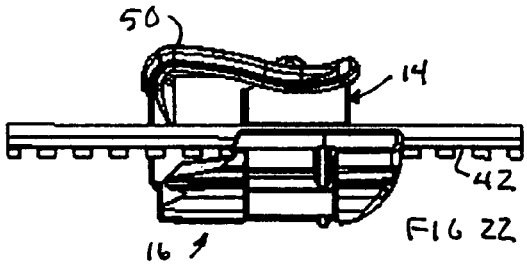
Figure 24:
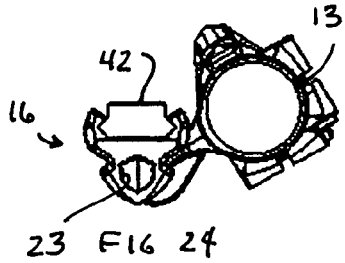
Figure 23:
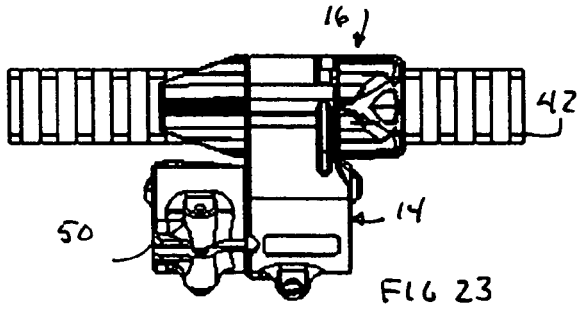
Figure 26:
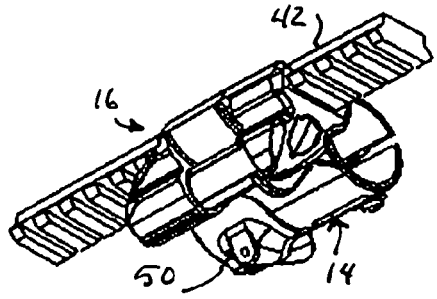
Figure 28:
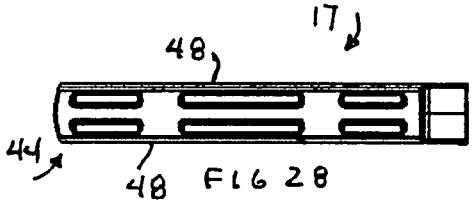
FIGS. 27-32 are various views of the locking axle of FIG. 5.
Figure 31:
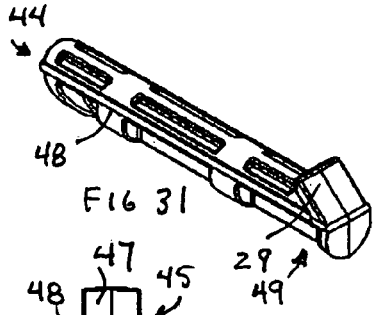
Figure 27:
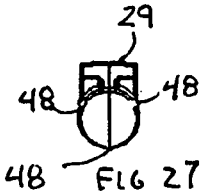
Figure 29:
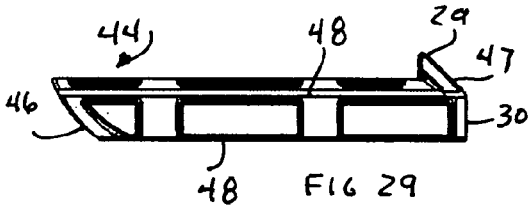
Figure 32:
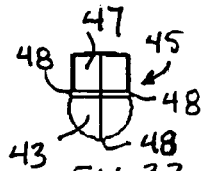
Figure 30:
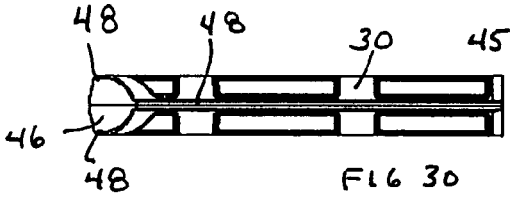
Figure 37:
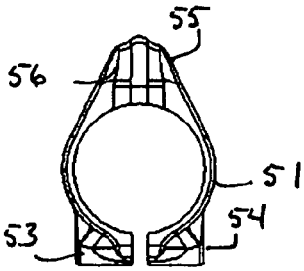
FIGS. 37-39 are various views of the belt clip of FIGS. 35-36 in greater detail.
Figure 38:
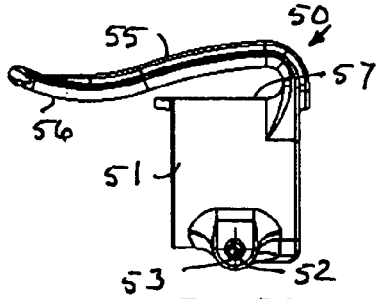
Figure 39:
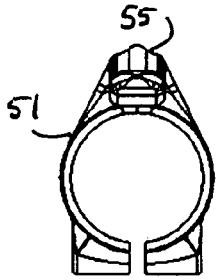

Rail body 16 (FIGS. 14-20) includes an arcuate opening 36 for selectively receiving either of flanges 33 therethrough into rail slot 12A. A space 27 defined between subtending flanges 26 has respective interior surface 26A both aligned around axis 23B. Post 22 closely fits within space 27 and is rotatable to three positions (FIGS. 1-3). Body 16 includes a rail channel 40 defined by walls 38 and bottom 39 that works with all standard pistol or Picatinny rails (see FIG. 18 and enlarged portion in FIG. 20). Rear surfaces 43 of body 16 are formed to rest against most trigger guards (FIG. 16).

Grooves 41 in rail body 16 are aligned and cooperate with grooves 37 in body 18 for selectively positioning mount 14 as shown in FIGS. 1-3.

FIGS. 21-26 illustrate the mount 14 and rail body 16 connected together and mounted on a standard rifle Picatinny rail 42.

FIGS. 27-32 illustrate locking axle 17 having an elongated body 30 with a front portion 44 and a rear portion 45. Front portion 44 includes an arcuate surface 46. The locking tab 29 has an inclined surface 47 that is undercut or flush with rear surfaces 43 of rail mount 16 so as not to interfere with contact with the trigger guard. Three detent bosses 48 extend substantially the length of body 30. A rear detent boss 49 extends outwardly a greater distance than bosses 48 and the bottom groove 41 is deeper than the other grooves 41 to accommodate boss 49.

Figure 33:
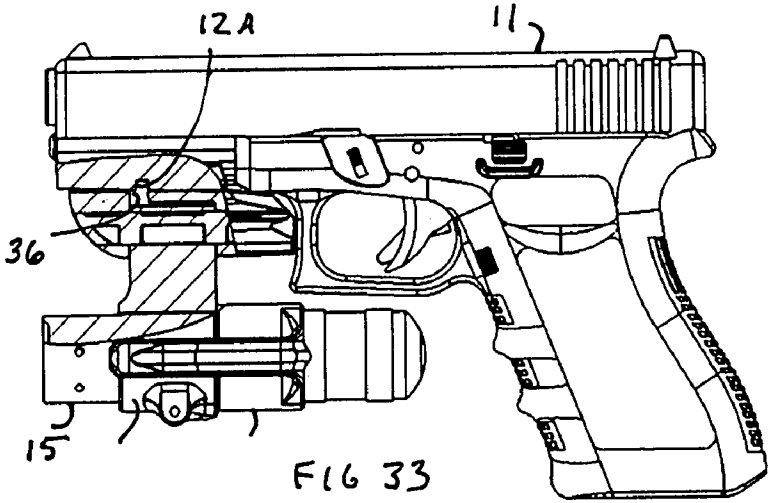
FIG. 33 is a partial cross-section of the mount of FIG. 1 showing the locking tab disengaged in the center portion.
Figure 35:
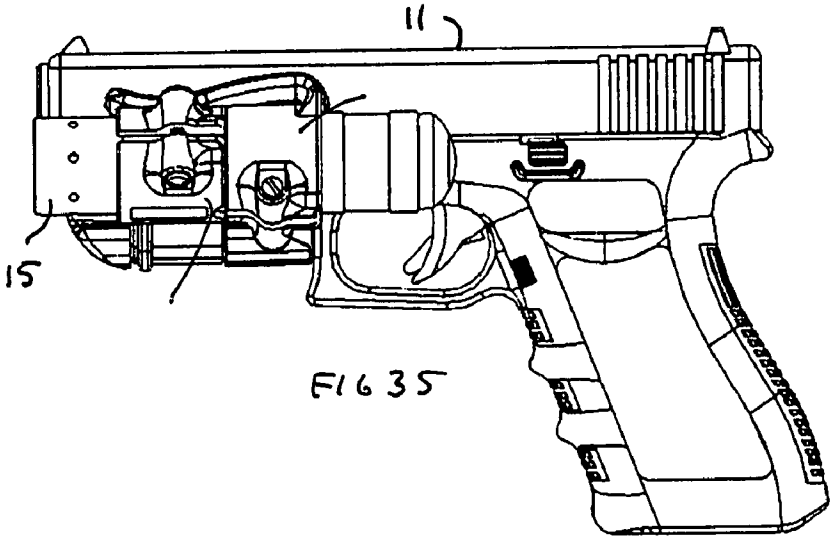
FIGS. 35-36 are perspective views of the mount of FIG. 1 with a belt clip in accord with the present invention.

FIG. 33 illustrates the release position for the rail mount in that rail locking tab 33 is not engaged in slot 36 and rail slot 12A. When the light mount 10 is in a down center position, the mount 10 may be easily and rapidly removed from the firearm 11.

Figure 34:
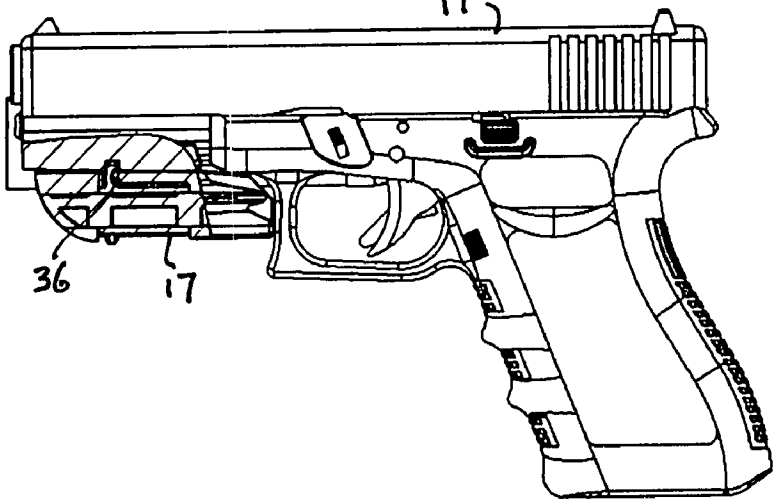
FIG. 34 is a partial cross-section of the locking tab of FIG. 33 engaged when the light carrier is rotated to the right position.
Figure 36:
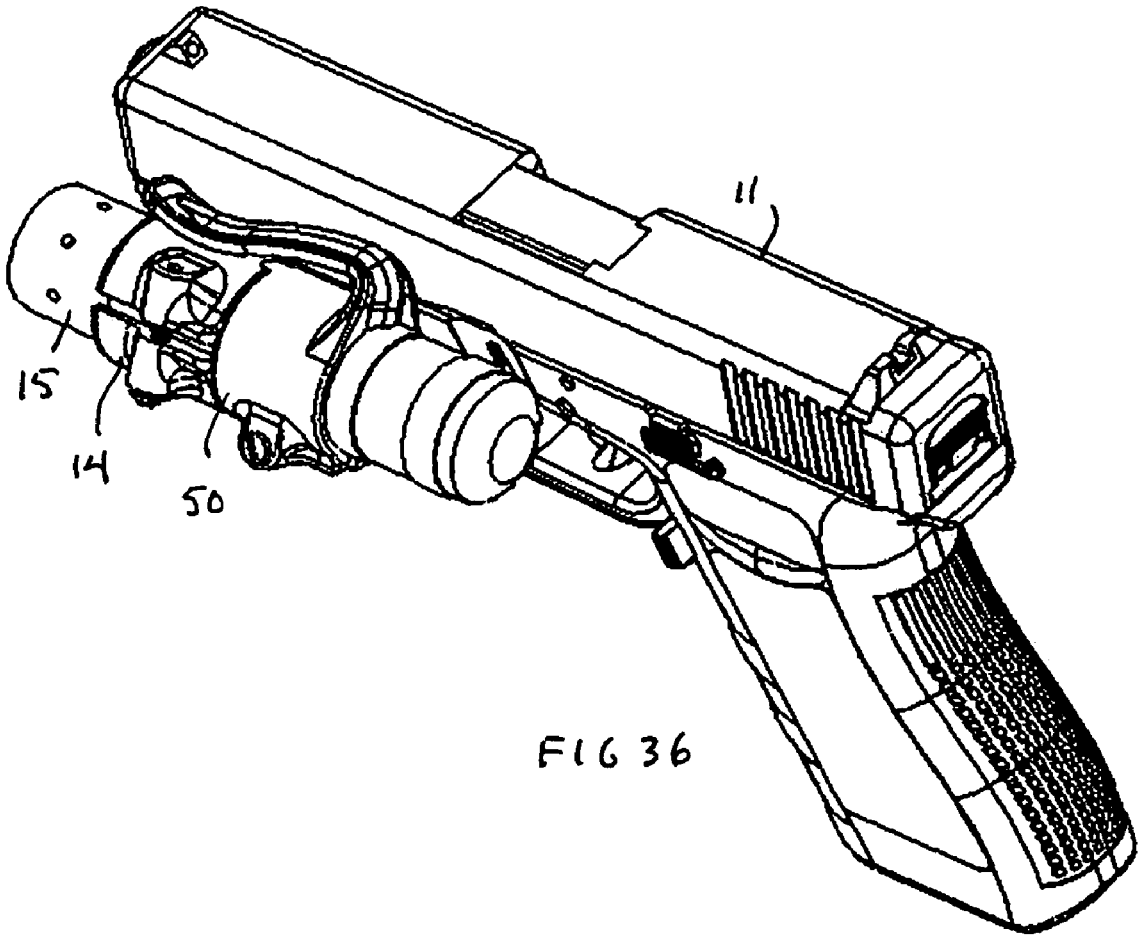

FIG. 34 illustrates rail locking tab 33 extending through slot 36 and into rail slot 12A when the mount 10 is rotated to place rotational light carrier 14 on the right side. When moved to the left the other tab 22 also will fit into slot 36 and slot 12A. In both cases, the mount 10 is held in a manner to prevent forward or rearward movement of the mount 10 with respect to the firearm.

The rotation of carrier 14 causes detent bosses 48 to move in aligned grooves 37 and 41 when carrier 14 is rotated and lock carrier 14 in a selected position. Locking tab 29 fits within walls 26B (FIG. 15).

Operation

Figure 43:
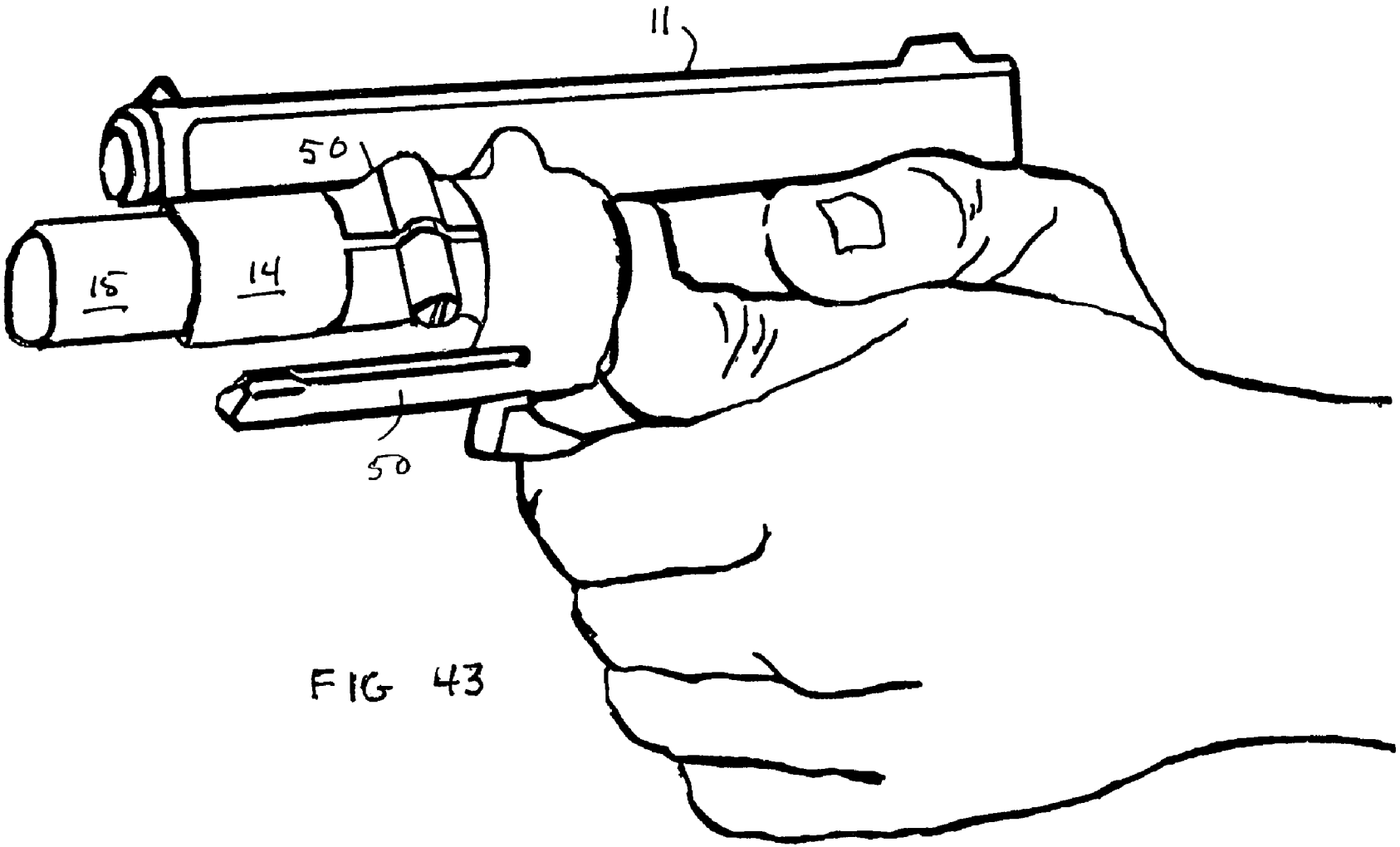
FIG. 43 is a pictorial view of the mounted light of 35-39 being operated by the user's hands.

The light mount 10 is assembled as shown in FIG. 5. Locking axle 17 is installed by having a tapered end portion 49 being press fit into rear passageway 26A in rail mount in rail mount 16 after the upper portion of light carrier 14 is placed in the space 27 of body 16 to align both axes 23A and 23B. Light 15 is inserted into carrier 14 either before or after the installation of light carrier 14 into rail mount 16. Screw 13 moves flanges 24 toward each other to frictionally engage a light 15 at a desired location and to dispose the light switch at the desired location as shown in FIG. 43. Rail body 16 is then slipped onto rail mount 12 (FIG. 4) or 42 (FIGS. 21-26).

Carrier 14 can then be rotated to either the right or left with a locking tab 33 preventing mount 10 from moving forward when light operating button 32 is depressed by a user. The mount 10 can be moved to the down center position for quick removal if desired.

As discussed hereinabove, mount 10 is easily installed or removed form gun rail 12, 42. FIGS. 35-39 illustrate a belt clip 50 employed to carry the mount 10 when it has been removed from a firearm 11.

Clip 50 includes a cylindrical body member 51 that can be compressed via a screw 52 through a passageway 53 and a threaded passageway 54 as well understood in the art. Integral arm member 55 includes a curved end portion 56 to engage a belt in the space between the top portion 57 of body 51 and the underside surface of arm member 55.

Figure 40:
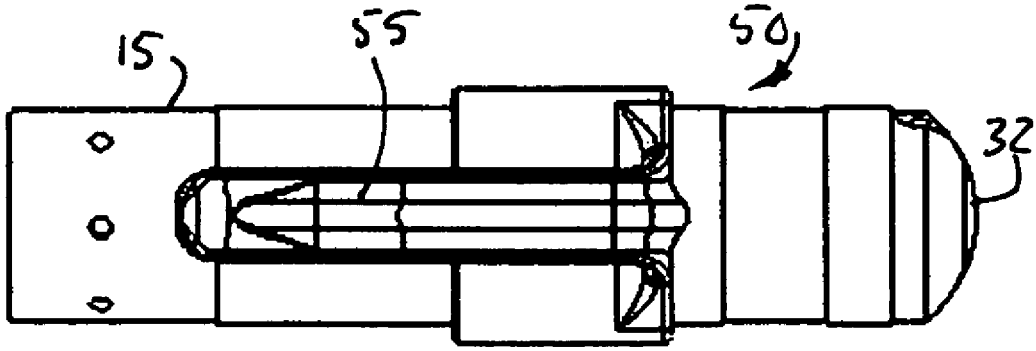
FIGS. 40-42 are various views of a light carried by the belt clip of FIGS. 37-39.
Figure 41:
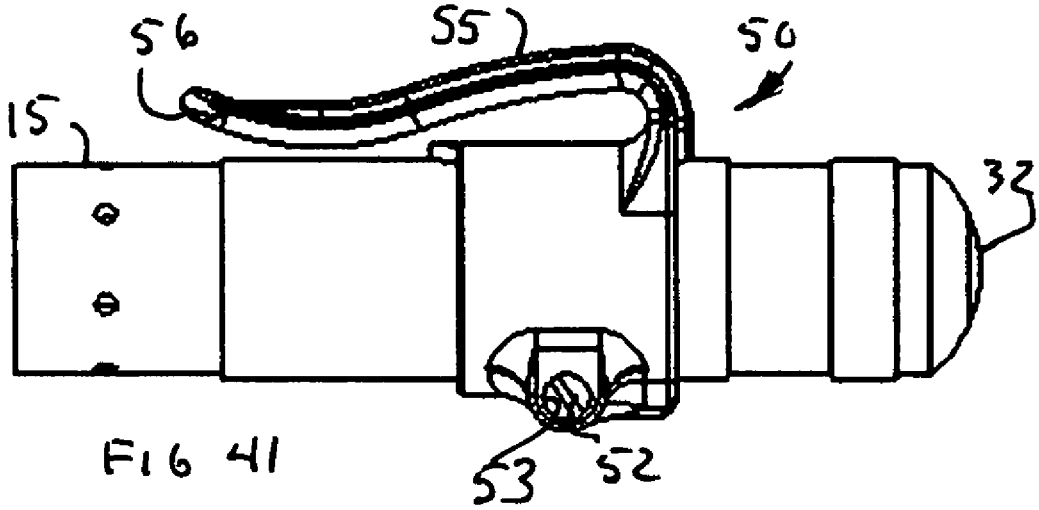
Figure 42:
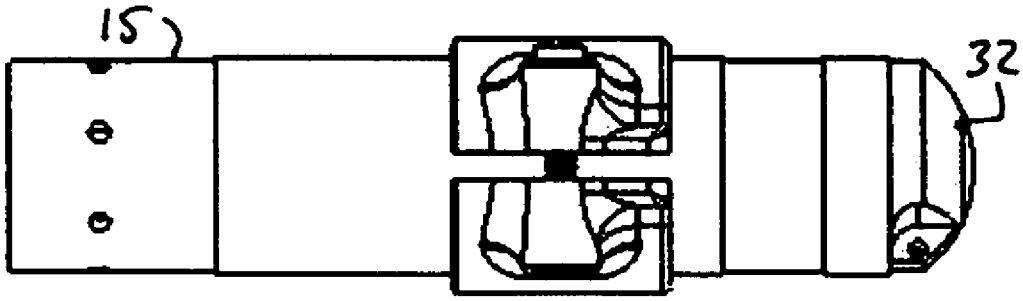

FIGS. 40-42 illustrates the versatility of clip 50 being attached to a representative flashlight 15 not mounted in a carrier 14.

FIG. 43 illustrates the use of the light mount of FIGS. 1-34 carrying belt clip 50. The relative dimensions and positioning of clip 50, light 15 and carrier 14 may be varied on the desires of the user. This also shows the positioning of the trigger hand and other hand of the user in operating the light switch and pulling the trigger in a two-handed stance of the user.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

The invention claimed is:

1. An adjustable rail light mount for removable attachment to a firearm having a mounting rail comprising:

a rail mount removably attached to a rail of such firearm;

a light carrier adapted for supporting a light attachable to said rail mount;

an axle member affixed to said rail mount;

said carrier having a passageway for receiving a portion of said axle therein for rotatably mounting said carrier to said rail mount;

a pair of cooperating engaging members located between said axle and said passageway in said carrier for securing said carrier in at least one position to locate a light carried by said carrier on at least one side of such firearm.

2. The mount as defined in claim 1 wherein said rail mount includes a pair of spaced subtending flanges each having a longitudinal passageway therethrough, said flanges defining an interior mounting notch therebetween, said passageways being aligned with a common longitudinal axis, said light carrier including an upstanding post member having a body and a longitudinal passageway therethrough aligned with said common axis, said axle being mounted through said passageways in said flanges and said passageway in said post member.

3. The mount as defined in claim 2 wherein said cooperating engaging members includes spaced first engaging elements formed in said passageway in said post member, and spaced second engaging elements formed on said axle, said first and second engaging elements cooperating to lock said second mounting member in a first position to locate a carried light on the left side of such firearm and a second position to locate a carried light on the right side of such firearm.

4. The mount as defined in claim 2 wherein said engaging members include spaced third engaging elements in said passageways in said flanges cooperating with said second engaging elements to secure said axle therein.

5. The mount as defined in claim 1 wherein said axle member includes a tapered end portion press fit into a passageway in said rail mount.

6. The mount as defined in claim 2 wherein said light carrier includes stop means for engaging a portion of a rail on such firearm to inhibit forward movement of said mount when said light carrier is in said first or second position.

7. The mount as defined in claim 2 wherein said first engaging elements are formed as a plurality of longitudinal grooves, said second engaging elements are formed as a plurality of longitudinal bosses, each said boss located in one said groove.

8. The mount as defined in claim 1 wherein said rail mount includes a channel member for attaching said rail mount to a rail of such firearm.

9. The mount as defined in claim 1 wherein said light carrier includes a hollow body for supporting a light, said body having a generally cylindrical shape and includes a forwardly disposed portion for protecting a light from muzzle blast when such firearm is fired.

10. The mount as defined in claim 1 further including a belt clip including a hollow body sized to locate said light carrier in said body of said clip, an arm member extending from said body of said clip for removably attaching said belt clip to a belt of a user when said rail mount is removed from a firearm.

11. An adjustable rail light mount for removable attachment to a firearm having a mounting rail with a notch therein comprising:

a rail mount removably attached to such rail;

a light carrier rotatably attached to said rail mount for movement between three spaced positions;

said rail mount including a pair of spaced subtending flanges each having a longitudinal passageway therethrough, said flanges defining an interior mounting space therebetween;

said light carrier including an upstanding post member having a body and a longitudinal passageway therethrough aligned with said passageways of said flanges;

said post member being located in said space in said rail mount;

an axle mounted through said passageways in said flanges; and said passageway in said post member for rotatably mounting said light carrier to said rail mount.

12. The mount as defined in claim 11 wherein said post member includes spaced first engaging elements formed in a portion of said carrier body, said axle including a member having spaced second engaging elements, said first and second engaging elements cooperating to lock said light carrier in a first position to locate a light carried by said light carrier on the left side of such firearm and a second position to locate a light carried by said light carrier on the right side of such firearm.

13. The mount as defined in claim 12 wherein said passageways in said flanges include spaced third engaging elements cooperating with said second engaging elements to secure said axle therein.

14. The mount as defined in claim 13 wherein said axle includes a tapered end portion press fit into said passageways in said flanges.

15. The mount as defined in claim 11 wherein said rail mount includes a channel member for attaching said rail mount to such rail of a firearm.

16. The mount as defined in claim 11 wherein said light carrier includes a hollow body for carrying a light therein; and a fastener for securing a light in said hollow body.

17. The mount as defined in claim 16 wherein said body is generally cylindrical in shape.

18. The mount as defined in claim 12 wherein said light carrier includes stop means for engaging such rail notch of said rail to inhibit forward movement of said rail light mount when said light carrier is in said first or second position.

19. The mount as defined in claim 12 wherein said first engaging elements include a plurality of longitudinal grooves, said second engaging elements include a plurality of longitudinal bosses, each said boss being located in one said groove.

20. The mount as defined in claim 11 further including a belt clip including a hollow body sized to locate said light carrier in said body of said clip, an arm member extending from said body of said clip for removably attaching said belt clip to a belt of a user when said rail mount is removed from a firearm.

* * * * *